United States Patent [19]

Kitzen

[11] Patent Number: 4,939,688

[45] Date of Patent: Jul. 3, 1990

[54] DYNAMIC RANGE CONVERTER PROVIDING A MULTIPLICITY OF CONVERSION RATIOS

[75] Inventor: Wilhelmus J. W. Kitzen, Eindhoven, Netherlands

[73] Assignee: U.S. Philips Corp., New York, N.Y.

[21] Appl. No.: 167,805

[22] Filed: Mar. 14, 1988

[30] Foreign Application Priority Data

Apr. 1, 1987 [NL] Netherlands ..... 8700763

[51] Int. Cl.[5] ..... G06G 7/32

[52] U.S. Cl. ..... 364/813; 364/857; 328/142; 328/143; 328/144; 328/145; 307/492; 307/498

[58] Field of Search ..... 364/813, 808, 602, 857, 364/814; 328/142–145; 307/492, 498

[56] References Cited

U.S. PATENT DOCUMENTS

| | | | |
|---|---|---|---|
| 2,879,002 | 3/1959 | Longerich | 364/813 |
| 3,086,166 | 4/1963 | Salvatori | 364/813 |
| 3,320,411 | 5/1967 | Martinez | 364/813 |
| 3,894,212 | 6/1975 | Figueroa | 364/813 |
| 3,953,721 | 4/1976 | Johnston et al. | 364/808 |
| 4,532,604 | 7/1985 | Baker | 364/813 |
| 4,562,591 | 12/1985 | Stikvoort | 381/106 |

*Primary Examiner*—John R. Lastova

*Attorney, Agent, or Firm*—Marianne R. Rich

[57] ABSTRACT

An electric signal converter utilizes a processing unit to establish a polynomial of n terms, each term being a power of the signal at the input terminal of the processor multiplied by an appropriate coefficient. Feedback of the input signal to the processor raised to the nth power through a multiplier, wherein an input signal to the converter is multiplied by the feedback signal and the product coupled to the input of the processor, provides signals at the output of the processor which establish the polynomial as a series of terms wherein each term is the signal at the input of the converter raised to a fractional power.

10 Claims, 1 Drawing Sheet

DYNAMIC RANGE CONVERTER PROVIDING A MULTIPLICITY OF CONVERSION RATIOS

Figure 1:
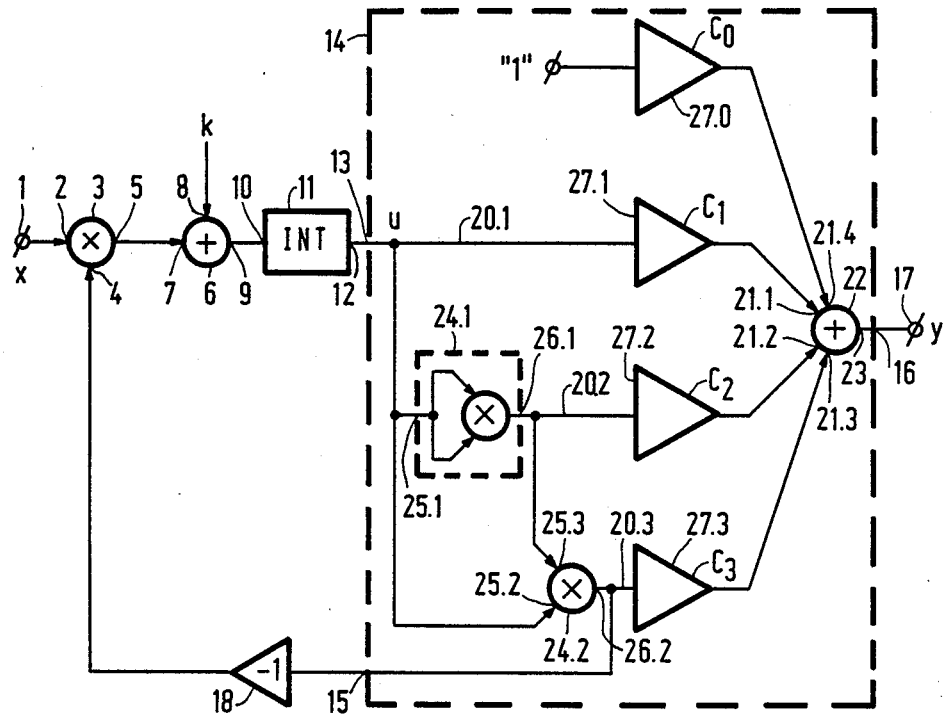

The invention relates to an arrangement for converting a first electric signal into a second electric signal; comprising an input terminal for receiving the first electric signal, a first signal combination unit having a first input coupled to the input terminal, a second input and an output, a signal processing unit having an input coupled to the output of the signal combination unit, a first output coupled to the second input of the first signal combination unit, and a second output, said signal processing unit being adapted to raise the signal applied to its input to a given power n and to apply the signal raised to the $n^{th}$ power to the first output, and being adapted to process the signal applied to its input and to apply the processed signal to the second output, an output terminal for supplying the second signal, said output terminal being coupled to the second output of the signal processing unit.

An arrangement of this type is known from U.S. Pat. No. 4,562,591 issued to Stikvoort and assigned to the assignee of the present invention, see FIG. 9, and is used in a dynamic range converter.

In the dynamic range coverter known from the above-cited Patent the signal processing unit is adapted in such a way that the input signal is also raised to the power b and is added to the second output. A conversion ratio of b/n can then be realised with the known dynamic range converter, in which n and b are both integers. In the case of a variable n and b, a number of conversion ratios can thus be realized from the smallest conversion ratio which is equal to 1/n and in which the steps between the conversion ratios are also equal to 1/n.

This means that for a limited, i.e. not too high maximum value of n and b the number of conversion ratios which is to be adjusted and which can be realized with a reasonable accuracy is limited.

It is an object of the invention to provide an arrangement which, when used in a dynamic range converter, can realize a larger number of conversion ratios with a reasonable accuracy and with which, if desired, conversion ratios which are smaller than 1/n can also be realized.

To this end the arrangement according to the invention is characterized in that the signal processing unit comprises at least two signal paths coupled between the input and a first and a second input, respectively, of a second signal combination unit and output of which is coupled to the second output of the processing unit and in that at least one of the signal paths comprises a power-raising means for raising the signal applied to its input by at least a power of one and for supplying this signal raised by at least a power of one to its output. The second signal combination unit may have an additional input for applying a signal of a constant value.

In the arrangement used in the dynamic range converter known from the above-cited European Patent Application the first signal combination unit is adapted to mulitply the signals applied to its first and second inputs, an integrator is arranged between the output of the first signal combination unit and the input of the signal processing unit, and the output of the first signal combination unit is coupled to a first input of a third signal combination unit which has a further second input and an output which is coupled to an input of the integrator. However, in this respect it is to be noted that the arrangement is not only intended for use in a dynamic range converter in which the output signal y is a function of the input signal x to a certain power, $y=x^{-p}$ in which p is the conversion ratio which is between 0 and 1 for a dynamic compressor. The same arrangement may alternatively be used in devices other than a dynamic range converter. For example, output signals can be realized with the arrangement in which the function of the input signal is different from the function $x^{-p}$, for example, the function $y=\log x$, as will be apparent hereinafter.

The invention is based on the following recognition. By feedback to the first signal combination unit a signal is produced at the input of the signal processing unit, which signal is proportional to the first electric signal, raised to a given power not equal to one. In the signal processing unit an expansion into a series is realized in the first electric signal raised to the relevant power. This series expansion is more accurate, that is to say, it is a better approximation of the desired signal as compared with the event in which a series expansion in the first electric signal itself would have been realized.

The second signal to be realized is thus better approximated according to the invention, so that a greater accuracy can be achieved.

If the first signal combination unit is adapted to add the signal at the first input to the signal at the second input, the second electric signal may be a signal which is proportional to the logarithm of the first electric signal.

The signal processing unit may comprise a first and a second signal path coupled between the input and the first and the second input, respectively, of the second signal combination unit, the first signal path comprising a first coefficient multiplier and the second signal path comprising a series arrangement of a squarer and a second coefficient multiplier.

However, a greater accuracy may alternatively be achieved if the signal processing unit comprises a third signal path between the input and a third input of the second signal combination unit, said third signal path comprising a series arrangement of another power-raising means and a third coefficient multiplier, the other power-raising means having a first and a second input coupled to the input of the processing unit and to the output of the squarer, respectively, and being adapted to multiply the signals applied to its two inputs and to apply the product to an output. It is of course evident that this coefficient multiplier which would multiply the signal applied to its input by a factor of 1 can be dispensed with.

According to the invention the arrangement thus comprises at least two signal paths in the signal processing unit. If the coefficient multipliers in the channels have a fixed value, this means that the coefficient multipliers in at least two signal paths must have a multiplication factor which is not equal to zero. If coefficient multipliers in the signal paths are optionally adjustable, the afore-mentioned requirement does not apply.

Figure 2:
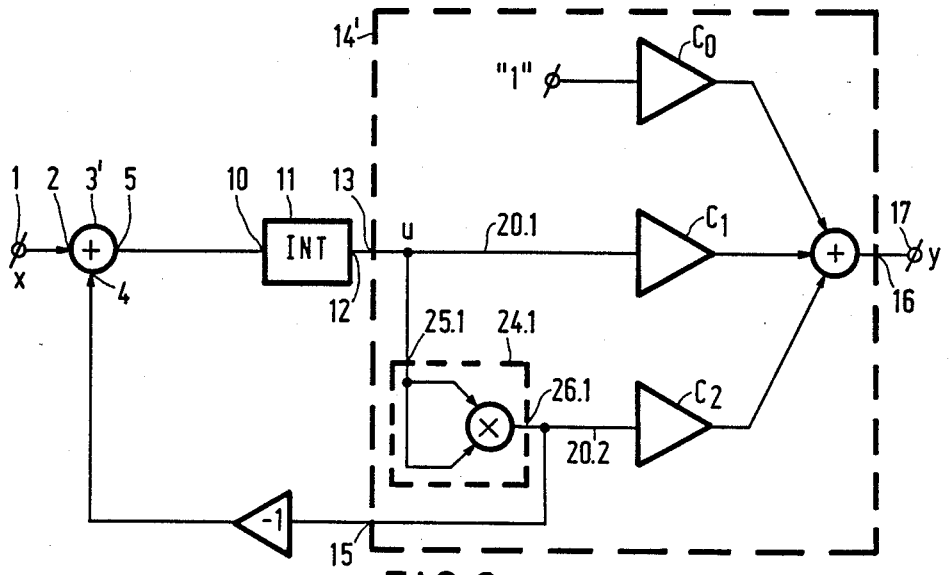

The invention will now be described in greater detail, by way of example, with reference to the accompanying drawing in which FIG. 1 shows a first embodiment which may be used in a dynamic range converter and FIG. 2 shows a second embodiment which may be used for realizing a logarithm function.

Identical reference numerals in the different Figures denoted the same elements.

FIG. 1 shows an embodiment of an arrangement having an input terminal 1 for receiving the first electric signal, which terminal is coupled to a first input 2 of a first signal combination unit 3 in the form of a multiplier. The output 5 of the multiplier 3 is coupled to a first input 7 of a signal combination unit 6 in the form of an adder. A constant signal having a value of k is applied to a second input 8 of the combination unit 6. The output 9 of the combination unit 6 is coupled to an input 10 of an integrator 11 which is also adapted to limit the signal to solely positive values so as to prevent instabilities. Such an integrator is described, for example, in European Patent Application No. 118,114, see FIG. 4 of this Application, more specifically the element denoted by the reference numeral 1204 in this Figure. The output 12 of the integrator 11 is coupled to a first input 13 of a signal processing unit 14. The processing unit 14 also has a second output 15 which is coupled via an inverting amplifier 18 to a second input 4 of the multiplier 3, and an output 16 which is coupled to the output terminal 17 for supplying the second electric signal. The processing unit 14 is adapted to raise the signal applied to its input 13 to a given power n (in FIG. 1 it holds that n=3) and to apply the signal raised to the $n^{th}$ power to the first output 15. The processing unit 14 is also adapted to process the signal applied to its input 13 and to apply the processed signal to the second output 16.

To this end the processing unit 14 is constructed as follows. The processing unit 14 comprises at least two signals paths (the embodiment of FIG. 1 comprises three signal paths). 20.1, 20.2, ..., coupled between the input 13 and associated inputs 21.1, 21.2, ... of a second signal combination unit 22. The output 23 of this signal combination unit 22 is coupled to the output 16 of the processing unit 14. At least one of the signal paths comprises a power-raising means for raising the signal appliet to its input by at least a power of one and for supplying this signal raised by at least a power of one to its output. The signal path 20.2. comprises a power-raising means 24.1. in the form of a squarer in which the signal which is applied to its input 25.1 is squared. The signal path 20.3 comprises a power-raising means 24.2 in the form of a multiplier in which the signal applied to its input 25.2 is cubed. To this end the second input 25.3 is coupled to the output 26.1 of the squarer 24.1. The output 26.2 of the multiplier 24.2 is coupled to the output 15 so that the cubed (n=3) input signal appears at the output 15.

The combination unit 22 has an additional input 21.4 for applying a signal $c_o$ of a constant value. The signal paths 20.1, 20.2 and 20.3 also comprise coefficient multipliers 27.1, 27.2 and 27.3, and coefficient multiplier 27.0 is present to which a constant value "1" is applied for obtaining the signal $c_o$.

The arrangement operates as follows. The signals in the arrangement are adjusted in such a manner that the signal at the input 10 of the integrator 11 becomes (substantially) equal to zero. Then the following relation holds:

$$k - x \cdot u^3 = 0 \tag{1}$$

or $$u = (x/k)^{-\frac{1}{3}} \tag{2}$$

The output signal y can then be written as follows:

$$y = \sum_{j=0}^{3} c_j u^j = \sum_{j=0}^{3} c_j \{(x/k)^{-\frac{1}{3}}\}^j \tag{3}$$

or for k=1

$$y = \sum_{j=0}^{3} c_j (x^{-\frac{1}{3}})^j \tag{4}$$

This means that the output signal y is written as a series expansion in the input signal x to a certain power not being equal to one.

This arrangement provides the possibility of realizing the function $f(x) = x^{-P}$ in which $0 \leqq P \leqq 1$ and $0 \leqq x \leqq 1$. The arrangement then operates as a compressor. This is evident as follows:

$$f(x) = x^{-p} = (x^{-1/n})^{pn} \approx \sum_{j=0}^{N-1} c_j (x^{-1/n})^j \tag{5}$$

and for N=4 and n=3 we have the series expansion of formula (4) in which $c_j$ can be determined via a series expansion in Chebyshev polynomials such that for x between, for example, 0.01 and 0.1 formula (5) has a minimum deviation with respect to the desired signal f(x). Formula (5) shows that there need not be any relationship between p and n so that also p can be chosen to be smaller than 1/n.

The function $f(x) = x^{-p}$ could also have been approximated directly by means of a series expansion $$y' = \sum_{j=0}^{N-1} c_j' x^j \tag{6}$$

in which $c_j'$ (j=0, ..., N−1) can also be determined by means of a series expansion in Chebyshev polynomials. Determination of $c_j'$ by means of an expansion into a series of Chebyshev polynomials actually yields those coefficients which, filled in formula (6), yield a signal y' which for a limited range of x (for example, $0.01 \leqq x \leqq 1$) has a minimum possible deviation with respect to the desired signal y. Yet, such a series expansion (not too large for N) does not appear to yield a sufficiently accurate result.

On the other hand, the series expansion in accordance with formula (5) yields a better result, that is to say, a smaller maximum deviation with respect to the desired signal f(x) than does formula (6), more specifically because of the following reasons. As has been stated, the range of the argument x is between, for example, 0.01 and 1 for formula (6). This means that the range of the argument $x^{-1/n}$ in formula (5) for n=3 is between approximately 1 and 5. Approximation of the function $z^{3p}$ by means of formula (5), in which z is between 1 and 5, is more accurate than an approximation of the function $x^{-p}$ for x between 0.01 and 1 by means of formula (6), apparently because of the fact that the gain in accuracy due to the reduction of the dynamic range of the argument is larger than the loss of accuracy due to the changed value of the power. Formula (5) for N=3 and n=2 thus yields a deviation which is at most equal to 2.5 dB. Better results are achieved if y is expanded into a series of $x^{-\frac{1}{3}}$, that is to say, n=3. For N=4 and $0.01 \leqq x \leqq 1$ formula (5), and hence formula (4) yield a deviation which is at most equal to 0.16 dB. Consequently, with the aid of formula (5) the desired function for any value of the conversion ratio p between $0 \leqq p \leqq 1$ can be realised with sufficient accuracy by suitable choice of the coefficients $c_j$.

In this respect it is to be noted that the theory of the series expansion in Chebyshev polynomials is known per se and is described, for example, in the book "Introdution to numerical analysis" by C.E. Fröberg (Addison-Wesley Pub. Co.).

FIG. 2 shows a second embodiment. In this embodiment the first signal combination unit 3' is an adder. The signal processing unit 14' is formed in a slightly different manner than the processing unit 14 of FIG. 1. In this case there are only two signal paths 20.1 and 20.2. It is, however, evident that more signal paths may be present to enhance the accuracy.

The arrangement operates as follows. The signals in the arrangement are adjusted in such a manner that the signal at the input of the integrator 11 becomes (substantially) zero. Then the following relation holds:

$$x - u^2 = 0 \tag{7}$$

or $$u = x^{178} \tag{8}$$

The output signal y can then be written as follows:

$$y = \sum_{j=0}^{2} c_j u^j = \sum_{j=0}^{2} c_j (x^{\frac{1}{2}})^j \tag{9}$$

Here again the output signal y is written as a series expansion in the input signal x to a certain power not being equal to one.

The function $y = \log x$ in which $0 < x \leqq 1$ can be realized by means of this arrangement. This is evident as follows:

$$f(x) = \log x = n \log x^{1/n} \approx n \sum_{j=0}^{N-1} c_j (x^{1/n})^j \tag{10}$$

and for $n = 2$ we have the series expansion in accordance with formula (9).

Using formula (10), an approximation of the function $f(x) = \log x$ can be realized which is more accurate than with the series expansion of formula (6), more specifically because of the following reasons. For formula (6) the range of the argument (x) is again between, for example, 0.01 and 1. This means that the range of the argument $x^{1/n}$ in formula (10) for $n = 3$ is between approximately 0.2 and 1. Approximation of the function 31 log z by means of formula (10), in which z is between 0.2 and 1, is more accurate than an approximation of the function log x for x between 0.01 and 1by means of formula (6). This is apparently due to the fact that the gain in accuracy as a result of the reduction of the dynamic range of the argument is larger than the loss of accuracy due to the addition of the multiplication factor n (=3) before the logarithm in formula (10).

It is to be noted that the invention is not limited to the embodiments shown. Various modifications of the embodiments shown are possible without passing beyond the scope of the invention as defined in the Claims. For example, the integrator, though present in the two embodiments, is not essential to the invention. The arrangement may of course alternatively be realized both in an analogue form and in a digital form.

What is claimed:

1. An arrangement for converting a first electric signal into a second electric signal, comprising an input terminal for receiving the first electric signal;

a first signal combination unit having a first input coupled to the input terminal, a second input and an output;

a signal processing unit having an input coupled to the output of the first signal combination unit, a first output coupled to the second input of the first signal combination unit, and a second output, the signal processing unit constructed and arranged to raise a signal coupled to the input thereof to a given power n and to couple the signal raised to the given power of n to the first output, and further constructed and arranged to process the signal coupled to the input of the signal processing unit and couple a processed signal to the second output thereof, and an output terminal coupled to the second output of the signal processing unit whereat the processed signal is provided, characterized in that the signal processing unit comprises at least two signal paths coupled between the input of said signal processing unit and respectively, to at least two inputs of a second signal combination unit having an output coupled to said second output of said processing unit and in that one signal path of said at least two signal paths comprises first power-raising means for raising a signal to a power of one and a signal path of said at least two signal paths other than said one comprises second power-raising means for raising a signal to a power of two.

2. An arrangement as claimed in claim 1, characterized in that the second signal combination unit has an additional input coupled to receive a signal of a constant value for combination with signals received at said at least two inputs.

3. An arrangement as claimed in claim 1 characterized in that said at least two signal paths of said signal processing unit comprise a first signal path and a second signal path respectfully coupled between said input of said signal processing unit and said first input and said second input, of said second signal combination unit, said first signal path comprising said first power-raising means and a first multiplier coupled to multiply signals from said first power-raising means by a first coefficient and said second signal path comprising said second power-raising means and a second multiplier coupled to multiply signals from said second power-raising means by a second coefficient.

4. An arrangement as claimed in claim 3, characterized in that the signal processing unit comprises a third signal path between said input of said processing unit and a third input of said second signal combination unit, said third signal path comprising a series arrangement of third power-raising means for raising a signal to a power of three and a third multiplier, said third power-raising means having a first input coupled to said input of said processing unit and a second input coupled to said second power-raising means, said third multiplier coupled to multiply signals from said third power-raising means by a third coefficient.

5. An arrangement as claimed in claim 4, characterized in that said third power-raising means is coupled to said first output of said processing unit so that n=3.

6. An arrangement as claimed in claim 4, characterized in that a fourth multiplier is coupled to a fourth input of said second signal combination means multiplies a predetermined signal by a fourth coefficient.

7. An arrangement as claimed in claim 6, characterized in that the first signal combination unit adds a signal at said first input thereof to a signal at said second input thereof.

8. An arrangement as claimed in claim 1, characterized in that the first signal combination unit is constructed and arranged to multiply a signal coupled to said first input thereof by a signal coupled to said second input thereof.

9. An arrangement as claimed in claim 7 characterized in that an integrator is coupled between said output of said first signal combination unit and said input of said signal processing unit.

10. An arrangement as claimed in claim 9, characterized in that said output of said first signal combination unit is coupled to a first input of a third signal combination unit having a second input coupled to receive a preselected signal and said third signal combination unit having an output coupled to an input of said integrator.

* * * * *